United States Patent [19]

Corbellini

[11] 4,162,937

[45] Jul. 31, 1979

[54] WATER-REMOVAL BLADE FOR PAPER-MAKING MACHINES

[76] Inventor: Glauco Corbellini, Via Carducci, 33100 Udine, Italy

[21] Appl. No.: 540,578

[22] Filed: Jan. 13, 1975

[30] Foreign Application Priority Data

Jan. 14, 1974 [IT] Italy ..... 83304 A/74
Nov. 11, 1974 [IT] Italy ..... 83421 A/74

[51] Int. Cl.[2] ..... D21F 1/48
[52] U.S. Cl. ..... 162/352; 162/374
[58] Field of Search ..... 162/352, 374, 351, 363, 162/211, 217

[56] References Cited

U.S. PATENT DOCUMENTS

| | | | |
|---|---|---|---|
| 2,694,345 | 11/1954 | Hornbostel | 162/352 X |
| 2,928,465 | 3/1960 | Wrist | 162/352 |
| 3,027,940 | 4/1962 | Dunlap | 162/352 |
| 3,140,225 | 7/1964 | Truxa | 162/352 |
| 3,497,420 | 2/1970 | Clark | 162/352 |
| 3,778,342 | 12/1973 | Charbonneau | 162/352 |

*Primary Examiner*—Marc L. Caroff
*Attorney, Agent, or Firm*—A. W. Briener

[57] ABSTRACT

A water-removal device for paper-making machines comprising a fixed beam; a blade having a leading edge; an upper bendable surface positioned behind said blade, and means for adjusting the bend in said bendable surface is described. By adjusting the curvature of the bendable surface, a series of vacuum curves can be obtained, thereby facilitating water-removal.

2 Claims, 9 Drawing Figures fig.5
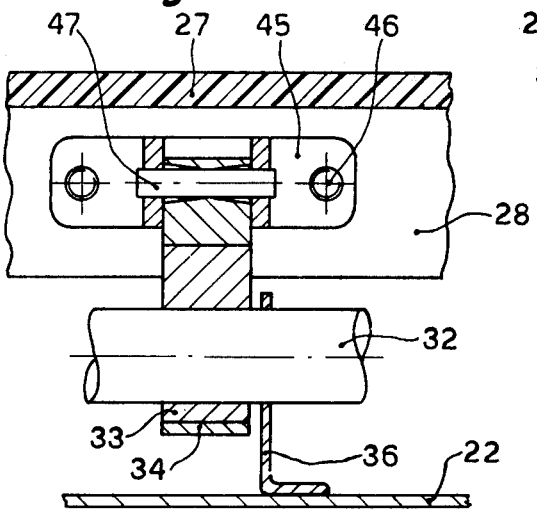
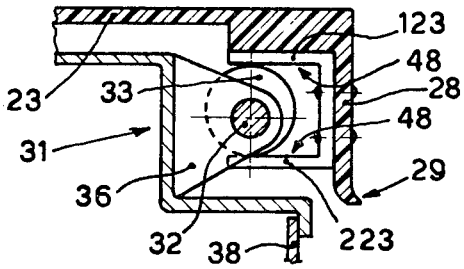
fig.6
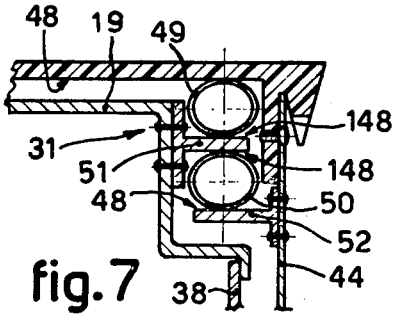
fig.7
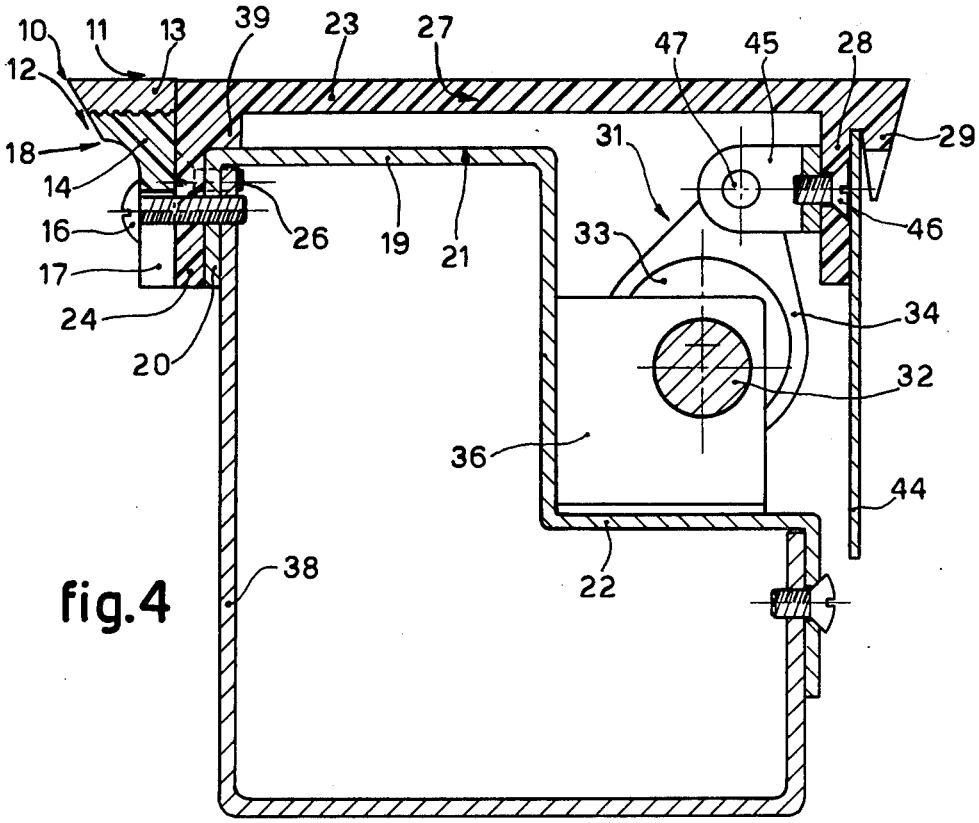
fig.4

WATER-REMOVAL BLADE FOR PAPER-MAKING MACHINES

FIELD OF INVENTION AND BACKGROUND

The present invention is directed to a water-removal blade or deflector for paper-making machines. More particularly, it is directed to a blade that can be applied to the flat or forming table in a paper-making machine and is able to accentuate the removal of water from the paper pulp deposited on the wire of the paper-making machine.

Various types of blades or deflectors for paper-making machines, employed to remove water, are known. Some blades are fixed; others have a variable angle of incidence, and some have a fixed leading edge and others have a replaceable leading edge. Further, the known water-removal blades can have their leading edge made of ceramics or of a metal alloy.

As is recognized, a water-removal blade for use with a paper-making apparatus has to satisfy a plurality of requirements, and it is for this reason that up to now so many types of blades have been suggested. One requirement is a high water-removal capacity in the face of variations in the characteristics of the pulp. For this reason blades with a variable angle of incidence have been suggested and made. In such blades the variability of the angle created between the direction of movement of the wire carrying the pulp and the upper surface of the blade creates a vacuum downstream from the leading edge which assists removal of water from the pulp. Another requirement is high resistance of the leading edge to wear so as to avoid frequent maintenance operations. Still another requirement is a low capacity for abrasion against the wire so as to avoid frequent replacements of the wire; and still another is low cost.

These requirements are fully met by the present invention which includes all the advantages of the previously known blades.

OBJECTS AND GENERAL DESCRIPTION

Accordingly, it is a primary object of this invention to provide an improved blade where it is possible to realize continuous adjustment of the vacuum profile in relation to the speed of passage of a continuous wire screen and in relation to the type of paper pulp from which the water is to be removed.

A further object is to permit the adoption of the most suitable or preferred material for the leading edge.

Another object is to permit repair to the leading edge of the blade to compensate for wear, rapidly and easily.

Yet another object is to make the parts of the blade which are subject to wear, i.e., the leading edge, inexpensive.

Other objects including, in the blade construction, the elimination of movable beams supported at their ends; the fact that expansions are made independent and not concurrent and superimposed on each other; the ease of construction and of adjustment of the moment of resistance depending on the width of the fixed table, will be apparent from the following detailed description.

The realization of the aforesaid objects in accordance with this invention provides an important series of advantages, including ability to adjust the drainage capacity to the requirements of the forming table and to the composition of the paper pulp; to be able to adopt the material most suitable for the type of forming table in realizing the leading edge or edge subject to wear; manufacture of the blade and the parts subject to wear at a low cost; the ability to repair the wear on the leading edge easily and continuously; and the construction of the machine so as to eliminate support of the type present in prior art blades.

These objects and advantages, together with further objects and advantages, are attained with a water-removal blade having a fixed beam for paper-making machines, the blade being characterized by including in reciprocal combination and cooperation:

an element with a vertically positionable leading edge made of a hard wear-resistant material;

an upper bendable surface located behind said leading edge;

a device for bending said upper surface, and an element for supporting and anchoring said parts.

DRAWING AND DETAILED DESCRIPTION

The water-removal blade with fixed beam in accordance with the invention will now be described with reference to the drawing which is provided for exemplificative and non-limitative purposes, wherein:

FIG. 4 illustrates another possible embodiment of a blade for a forming table in accordance with the invention;

FIG. 5 illustrates another possible embodiment for controlling the vacuum curve of the upper bendable surface;

FIG. 6 and 7 illustrate two other embodiments for controlling the vacuum curve of the upper bendable surface;

In the various figures of the drawing, the same parts or parts having the same functions are given the same reference numbers.

Figure 1:
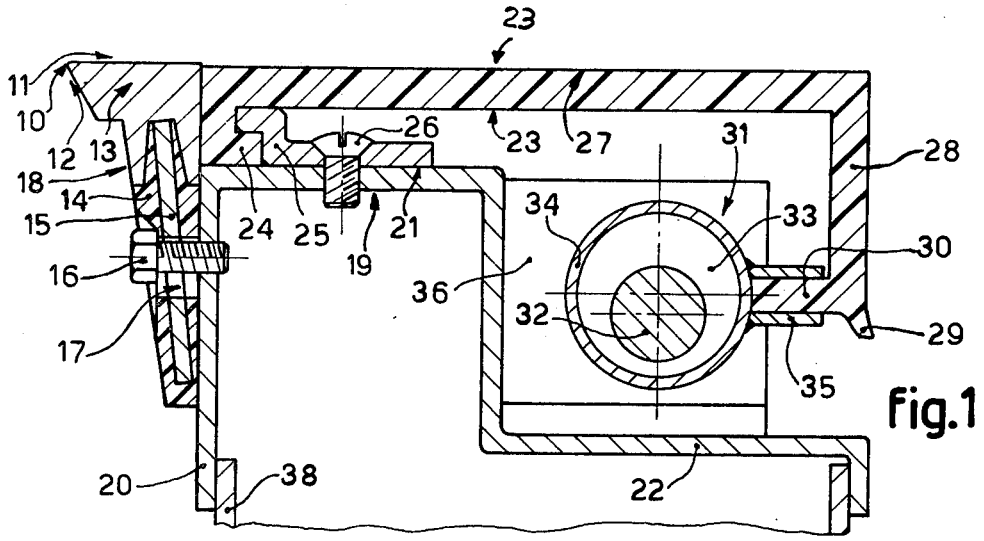
FIG. 1 illustrates the upper part of a blade for a forming table in accordance with the invention.
Figure 3:
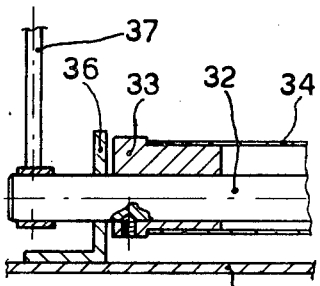
FIG. 3 illustrates a preferred device for controlling the vacuum curve of the upper bendable surface.
Figure 2:
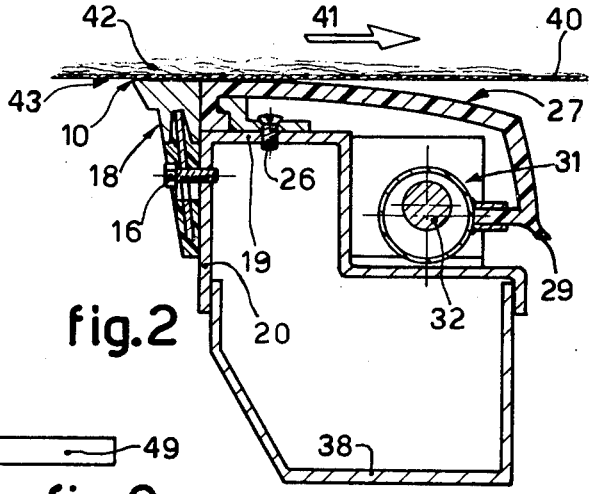
FIG. 2 illustrates the blade of FIG. 1 in a working position.
Figure 9:
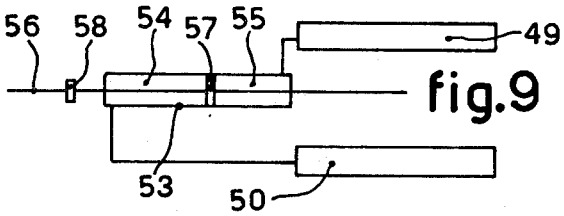
FIG. 9 illustrates a preferred device for controlling the embodiments of FIGS. 7 and 8.

In the drawing, referring primarily to FIGS. 1 and 2, blade 13 is a continuous element made of hard wear-resistant material and has leading edge 10, upper sliding surface 11, front dripping surface 12, and legs 18. This blade can be made of a hard cobalt alloy, ceramic, stainless steel, a sintered material, or of any other suitably hard material. In the embodiment shown in FIGS. 1 and 2, the blade is anchored to support 14, made of a resin or of a metal alloy, by legs 18. Support 14 can include a reinforcing element 15. 19 (or 119 in FIG. 8) is an upper supporting and anchoring element and includes a front portion 20, upper plane 21 and a rear plane 22. Blade 13 is adjustably, vertically positioned on 20 by screw 16 passing through slots 17 in support 14. 23 refers generally to the continuous upper bendable surface of the apparatus and, in FIGS. 1 and 2, consists of plane 27; tooth 24 continuous with one end of plane 27; and a connecting section 28 continuous with the other end of plane 27, which section can have at its end a drip device 29. Tooth 24 in cooperation with bracket 25 and screw 26 serves to anchor plane 27 in spaced relation to plane 21. Continuous upper body or plane 27 is shown to have a continuous thickness, but may be made to have a variable thickness or a variable transverse section to obtain the desired water-removal curve. The bendable surface is connected through protrusion 30 on section 28 with a cooperating element 31 employed to carry out the bending. 32 is a drive shaft on element 31 solidly and concentrically attached to element 33 which is able to rotate within hollow cylinder element 34. Element 34 has retaining means 35 by which it is anchored to protrusion 30. Shaft 32 is periodically supported by the supports 36 and bears at its end an activating lever. The shaft 32 and element 33 are anchored to each other. Below the upper surface 20 there is provided a lower supporting and stiffening element 38 which is dimensionally adjusted to the requirements arising from the bending moment and from the maximum camber permitted on the blade. Element 38 may be of a box-type or may consist of an I-iron, for example, shaped like a double T. The beam thus obtained may be supported and anchored in various ways, for example, by means of a cradle or by means of supports at its ends.

In FIGS. 4 and 5, there is shown another embodiment wherein the continuous bendable surface 23 is anchored to the body portion 20 by means of a screw 16 and having tooth 39 to permit vertical positioning. At its rear, the surface 23 has a drip device 29 which permits the mounting of a protection shield 44 positioned between drip device 29 and section 28 which connects the bendable surface to element 31. On the connecting section 28 is fixed fork 45 connected by means of screw 46. The connecting rod 34 is anchored in a swinging manner to fork 45 by retainer 47. Therefore, by acting on shaft 32, cam 33 is made to rotate and this in turn causes a displacement of connecting rod 34 which by means of retaining pivot 47 and fork 45, causes the desired bending of the continuous plane 23 in its upper part 27. In this embodiment, front element 18 of blade 13 and support 14 made of resin are welded together by means of gluing with resin in a mold. The continuous element, again, is made of a hard material.

The device functions as follows:

Wire 40 (FIG. 2) moves in the direction 41 and is supported by a plurality of water-removing blades positioned crosswise to the wire and parallel to each other. Paper pulp 42 from which water is to be removed is deposited on movable wire 40. Water-removal takes place by water being drawn out and through wire 40 between the blades. Thus, the water is displaced from the lower surface 43 of the wire when the wire pushes against the blades. Removal of water is performed by the leading edge 10 which, with its upper surface 11, supports the wire 40 and by front surface 12 which eliminates the water. In the event the passage of water through the wire 40 is not accentuated, the wire necessarily has to be very long. In accordance with the present invention, use is made of the venturi effect created by the speed of wire 40. Where the venturi effect has been used in prior devices, the continuous upper surface of the device has been stationary and positioned either in an unmoving manner or with the whole beam rotating. In accordance with the present invention, however, continuous upper surface 27 is bendable in accordance with a desired curve. The result of this bending is that the beam positioned normally with the continuous upper surface 27 straight, parallel, or almost straight to the wire 40, it is possible to create a whole series of vacuum curves by acting on cam 33 or on some other suitable device. The continuous upper surface 27 can have a constant or variable thickness or variable transverse section with a view to make it possible to obtain the desired water-removal curve.

In FIGS. 6–9, there is shown preferred examples of devices for bending the upper surface 23. In the example of FIG. 6, the cam 33, which is activated by shaft 32 periodically sustained by the supports 36, cooperates with two opposed seatings 48 machined on the surface of the projections 123 and 223, which form one single body or are substantially made into one single body by the element 23. The fact that the cam 33 is able to affect substantially the whole length of the continuous surface 23 (apart from short stretches where the supports 36 are provided) makes it possible to obtain a fine and constant adjustment along the whole length thereof. The adjustment is obtained by rotating cam 33, which preferably will be circular. Cam 33 acts on the two faces 48 and displaces them temporarily in respect of the axis of rotation of the shaft 32, thus forcing the whole continuous surface 23 at its rear part to rise or drop as desired. The projections 123 and 223 have been realized in the figure with a metal "C" element, but could also be produced directly in element 23 and its tail 28.

Figure 8:
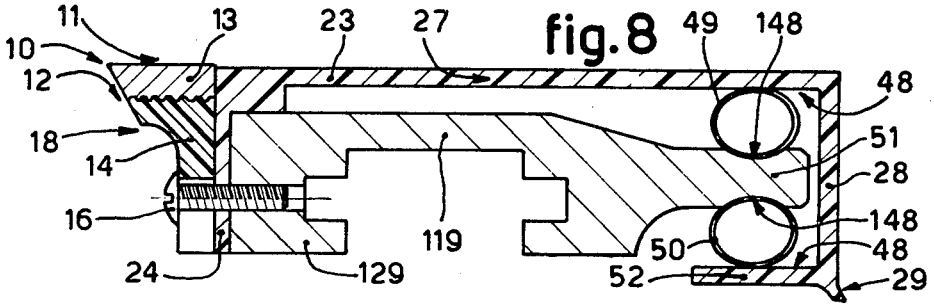
FIG. 8 illustrates an application of the invention to an insert for supports already existing.

In FIGS. 7 and 8 there is shown a device for carrying out adjustment by means of tubes 49–50 that can be expanded elastically and are charged with a fluid, water for example, at a preloading pressure P equal in both tubes. The elastically expandable tubes 49 and 50 press continuously against at least two faces. In the embodiments shown, they press as follows: the tube 49 presses against the continuous inner movable face 48 of surface 23 and against the continuous unmoving face 148 of the support 51 anchored to the upper element 19 or 119. Tube 50 presses against the continuous unmoving face 148 of the support 51 and against the continuous movable face 48 of the support 52 anchored to the shield 44 (which could also be an elongation of the element 28). The two continuous faces 48 are opposed and face each other, and there is a rigid connection between them which positions them mutually in a stable manner. The two continuous faces 148 are positioned on the two surfaces of the fixed support 51 located in an intermediate position between the two continuous faces 48.

By modifying simultaneously and in opposite directions by a substantially equal amount, the pressure P present in the expandable tubes 49–50, a vertical displacement of the rear end part of the bendable surface 23, is obtained in relation to the fixed support 51. This displacement causes a displacement that gradually disappears over the whole upper surface. The difference in pressures together with the elasticity of the bendable surface 23 conditions the value of the curvature of said surface 23. To bring about this difference in pressures, it is possible to use any commercially available system, and this does not constitute the essence of the present invention. For example, a preferred system, referring to FIG. 9, could consist of a cylinder 53 with a piston 57 and a rod 56 passing therethrough so as to balance the volumes. The cylinder could have two chambers 54 and 55 connected respectively to the expandable tubes 50 and 49. If now an equal pre-loading pressure P is created in 49 and 50, it is sufficient to move the piston 57 in the cylinder 53 to obtain the desired difference in pressures to vary the volumes as realized. Such a cylinder can be provided for each beam or can be applied only as required by means of rapid water-tight joints. To position the piston 57 in the cylinder 53 it is possible to use a threaded ring 58 cooperating with one or both of the protruding stems 56.

There has been described a preferred but non-limitative embodiment of the invention, but other solutions are possible. Thus, element 13 could be made of stainless steel, ceramics, a hard sintered alloy of metallic carbides, or of an alloy based on cobalt; leading edge 10 could be made up of a plurality of elements or of one single element which covers the whole front of the blade; tail 29 could descend to such an extent as to affect a guide present, for example, on the casing 38 and provide a closed chamber between the element 23 and the element 19. The result of this would be that by providing the continuous upper surface 27 with a plurality of holes or slots it would be possible to accentuate, by means of a suitable vacuum action present in the internal cavity of the beam, the suction action and thus to combine the water-removal functions of the blades with the functions of suction boxes in one single blade. It would also be possible to modify the system for bending the continuous upper surface 27 by providing a pressure cam, a plurality of pulleys winding up ropes applied to the tail 29, etc. It would also be possible to vary the proportions of the individual parts, just as it would be possible to provide some adjustment screws acting below the element 14 to level the position thereof.

These and other modifications can be made by one skilled in the art without departing from the essence of the claimed invention.

It is claimed:

1. A water-removal device for paper-making machines comprising support means, a blade element having a leading edge made of hard wear-resistant material, means for anchoring said blade element to said support means, an upper bendable surface positioned behind said blade element, and bending means constructed and arranged with said upper bendable surface for bending said bendable surface to create a venturi effect, said bending means including activating and positioning means and being constructed and arranged to provide continuous adjustment to the bending of said bendable surface during the operation of said paper-making machine and wherein said bending means includes a plane surface having a front anchorage means at one end thereof, and a connecting section at the other end thereof; and in reciprocal coordination a drive shaft positioned below and transversely to said upper bendable surface and said activating and positioning means being a lever attached to said drive shaft; a plurality of cams cooperating with a connecting rod in a swinging manner to a fork solidly fixed to the connecting section of said upper bendable surface.

2. A water-removal device for paper-making machines comprising support means, a blade element having a leading edge made of hard wear-resistant material, means for anchoring said blade element to said support means, an upper bendable surface positioned behind said blade element, and bending means constructed and arranged with said upper bendable surface for bending said bendable surface to create a venturi effect, said bending means including activating and positioning means and being constructed and arranged to provide continuous adjustment to the bending of said bendable surface during the operation of said paper-making machine and wherein said bending means includes in reciprocal coordination a drive shaft with said positioning and activating means being a lever attached to said drive shaft; and a plurality of cams cooperating with the two continuous opposed faces of a C-shaped element positioned below and in cooperation with said bendable surface.

* * * * *